US006168074B1

(12) United States Patent
Petriekis et al.

(10) Patent No.: US 6,168,074 B1
(45) Date of Patent: Jan. 2, 2001

(54) END OPENING BULK MATERIAL BOX

(75) Inventors: Paul F. Petriekis, Palos Park; Michael Wilford, Downers Grove, both of IL (US)

(73) Assignee: Packaging Systems, Inc., Romeoville, IL (US)

( * ) Notice: Under 35 U.S.C. 154(b), the term of this patent shall be extended for 0 days.

(21) Appl. No.: 08/876,596

(22) Filed: Jun. 16, 1997

Related U.S. Application Data

(63) Continuation-in-part of application No. 08/473,095, filed on Jun. 7, 1995, now Pat. No. 5,639,015, which is a continuation-in-part of application No. 08/253,955, filed on Jun. 3, 1994, now Pat. No. 5,419,485.

(51) Int. Cl.[7] ..... B65D 5/32; B65D 5/54

(52) U.S. Cl. ..... 229/122.24; 229/122.26; 229/243; 229/918; 229/919

(58) Field of Search ..... 229/177.26, 122, 229/122.24, 122.26, 199, 240, 242–244, 915, 918, 919

(56) References Cited

U.S. PATENT DOCUMENTS 2,606,709 * 8/1952 Carey et al. .
2,823,846 * 2/1958 George .
3,099,379 * 7/1963 Stease .
3,206,104 * 9/1965 Cohen ..... 229/117.26
3,214,076 * 10/1965 Gagnon .
3,253,764 * 5/1966 Goetschius et al. .
3,756,471 * 9/1973 Wissman .
3,905,541 * 9/1975 Paxton .
3,993,239 * 11/1976 Exel .
4,549,673 * 10/1985 Kupersmit .
4,793,494 * 12/1988 Gordon, Jr. .
4,815,631 * 3/1989 Eeg et al. .
4,986,466 * 1/1991 Colby ..... 229/126
5,054,644 * 10/1991 Greenslade .
5,143,278 * 9/1992 Petriekis et al. .
5,265,753 * 11/1993 Moorman .
5,333,777 * 8/1994 Roth .
5,335,844 * 8/1994 Young .
5,419,485 * 5/1995 Petriekis et al. ..... 229/918
5,639,015 * 6/1997 Petriekis et al. ..... 229/918

* cited by examiner

*Primary Examiner*—Gary E. Elkins
(74) *Attorney, Agent, or Firm*—Wallenstein & Wagner, Ltd.

(57) ABSTRACT

An end opening bulk material container having a polygonal-shaped sleeve defined by a double sidewall and a plurality of sidewalls. The double sidewall is defined by a first sidewall overlapping a last sidewall. The sleeve has a depth dimension greater than its width dimension. A first end of the sleeve is closed by a first end wall and a second end of the sleeve is closed by a second end wall.

39 Claims, 16 Drawing Sheets

100
210
106
108
6
30
32
34
36
38
40
46
48
62
64
66
68
70
72

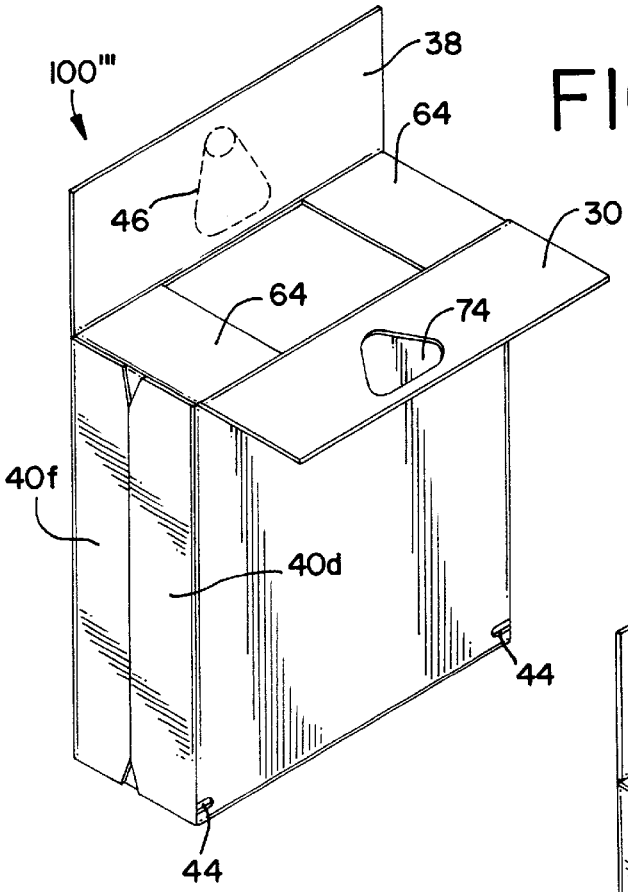
FIG. 20
FIG. 21
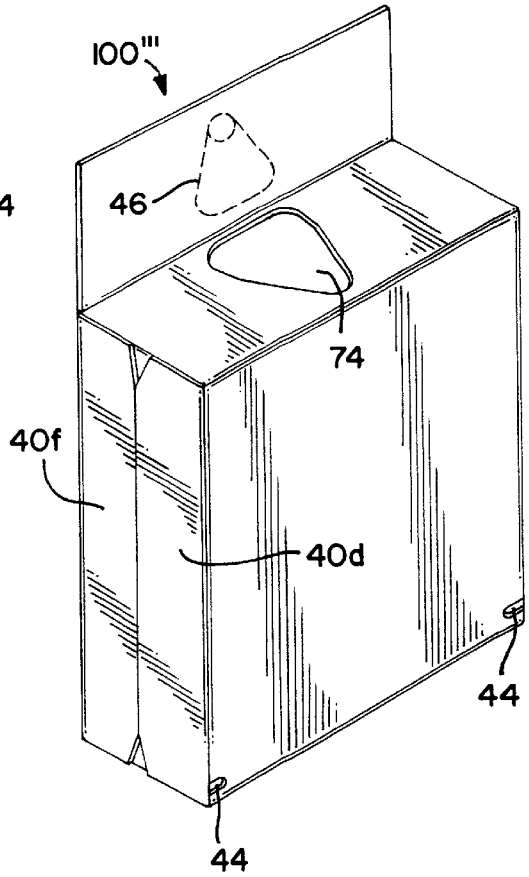
FIG. 22
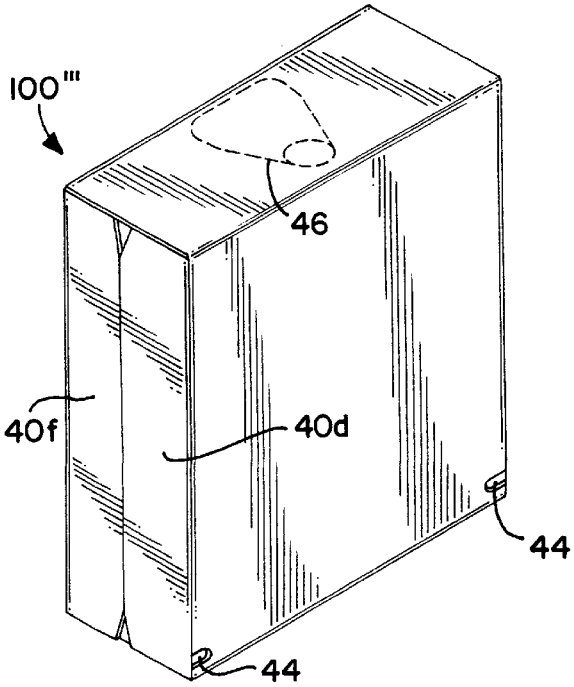

60VII
60VIII
60IX
60X
60XI
46
62
64
66
68
70
124
122
62a
62b
64a
64b

END OPENING BULK MATERIAL BOX

RELATED APPLICATIONS

The present application is a continuation-in-part of pending application Ser. No. 08/473,095, filed Jun. 7, 1995, now U.S. Pat. No. 5,639,015 issued Jun. 17, 1997, which is a continuation-in-part of application Ser. No. 08/253,955, filed Jun. 3, 1994, now U.S. Pat. No. 5,419,485, issued May 30, 1995.

TECHNICAL FIELD

The present invention relates generally to bulk material containers and specifically to reinforced corrugated flatboard containers for shipping liquid filled bags.

BACKGROUND OF THE INVENTION

Liquid products such as soft drink syrup or chemical products are often shipped in small volumes such as five gallon portions. These liquid volumes may be packaged in a plastic bag and housed within a paperboard container to protect the bag from puncture or compression. This method of packaging is often referred to as "bag in box." The bag is often provided with a fitment or a spout and the box with a corresponding access door to allow access to the contents of the bag through a wall of the box.

Prior boxes that have been specially designed to enclose and transport these five gallon bags usually are six sided boxes folded from a single sheet of corrugated paper that is folded and glued along a single glue lap to an outside wall of the box. The boxes usually have bottom and top walls that are formed from the overlap of major and minor flaps, and the box usually folds flat for storage. The boxes also have a perforated section along an end wall that may be removed to accommodate the spout so that liquid may be removed from the bag without opening the top of the box.

However, these prior boxes have presented several problems to manufacturers and distributors. For example, distributors have discovered that these boxes have insufficient structural support and that movement of the liquid filled bag within the box may cause the box to unfold or breakdown during warehousing and distribution. Further, the boxes have inadequate stacking strength and may crush, or have its perforated spout break out or the box may otherwise be damaged under the weight of a palletized load. In more serious cases where the perforated spout breaks out, a tear may form in a side or end panel of the box and continue along paperboard corrugations causing the box to rip open. In these cases, the box is rendered incapable of protecting the contents of the bag from outside hazards.

Manufacturers and distributors have also encountered problems with this box. For example, the glue lap that was provided to hold prior boxes together, oftentimes became unglued during the loading of the box with a liquid filled bag causing the entire box to unfold. Further, the manufacturers have had difficulty in detecting leaks in these boxes until after the boxes have been filled and prepared for shipment or actually shipped. Manufacturers have also had difficulty, in loading the prior boxes, to get the liquid filled bags to cover the entire bottom of the box for even weight distribution.

Improvements have been made to the single piece containers by constructing a container from three separate pieces of corrugated paperboard. An example of such a container is disclosed in U.S. Pat. No. 5,143,278 which is assigned to the owner of the present invention and is incorporated herein by reference. The '278 Patent discloses a top loaded container which has reinforcing flanges that add considerable support to the container far in excess of single piece boxes. However, even the container disclosed in the '278 Patent must be stacked on a pallet with each box in conformation with the lower box, that is sidewall over sidewall and end wall over end wall, in a column stacking pattern to avoid damaging the container on panels 32 and 36 between side flanges 120.

For these reasons, it is desirable to produce a more cost effective box for shipping liquid filled bags, that has greater stacking strength than boxes presently being used so that the boxes may be stacked on a pallet in an interlocking fashion, that is one box may be placed transverse to a lower box, or shipped in single increments by common courier such as U.P.S.

SUMMARY OF THE INVENTION

The present invention provides a reinforced corrugated paper box and corrugated paper blanks for forming the box that may be used for the shipment of liquid filled bags, and other bulk material.

According to the present invention, a container is provided having a polygonal-shaped sleeve defined by a double sidewall and a plurality of sidewalls. The double sidewall is defined by a first sidewall overlapping a last sidewall. Preferably, there are four sidewalls defining a rectangular sleeve. The sleeve has first and second ends, inner and outer surfaces, and a depth and a width dimension. The depth dimension is greater than the width dimension. The sleeve has a smooth inner surface. A first end wall located at the first end of the sleeve closes the first end of the sleeve. A second end wall located at the second end of the sleeve closes the second end of the sleeve.

An access door is provided in an end wall, preferably the second end wall, to allow access to the contents of a bag stored within the container. The door has a detachable section that preferably is circular in shape.

Preferably, the box has one or two holes in one of the walls of the container. These holes allow for the passage of air and liquid. Consequently, when a liquid filled bag is dropped into the box, air is displaced through the hole or holes allowing the contents of the bag to evenly distribute over the second end wall of the box. Also, the holes allow for early leak detection by allowing liquid to pass out of the box immediately after the leak occurs.

The present invention also provides for a system for forming the container described above. The system includes corrugated paper blanks for cooperatively forming the present container. To form the preferred rectangular container, the blanks comprise an elongate body blank with opposed lateral sides, and two side blanks each having opposed lateral sides, and opposed top and bottom ends. The container may also be formed using one side blank with two top ends, two lateral sides, and one bottom end. Transverse fold lines extending between the opposed lateral sides of the body blank divide the body blank into a first, a second, a third, a fourth and a fifth panel. Body flanges extend from the opposed lateral sides of the body blank from the second, third and fourth panel. These body flanges attach the body blank to the side blanks.

The side blanks preferably have top and bottom closing flaps that are foldable to form supports parallel to the stacking access of the container. Preferably the side blanks are made from two ply corrugated paperboard.

The three piece construction of the container allows one to interchange the stock of material used to build the container. For example, one could use a single ply corrugated paper for the body blank, and a double ply corrugated paper for the side blanks. The double ply corrugated paper sidewalls will add substantial structural support to the box.

BRIEF DESCRIPTION OF DRAWINGS

FIG. 20 is a perspective view of an alternate embodiment of the container constructed using the body blank shown in FIG. 18 and the side blank shown in FIG. 19, with the minor flaps folded to a closed position;

FIG. 21 is a perspective view of an alternate embodiment of the container constructed using the body blank shown in FIG. 18 and the side blank shown in FIG. 19, with one major flap and both minor flaps folded to a closed position;

FIG. 22 is a perspective view of an alternate embodiment of the container constructed using the body blank shown in FIG. 18 and the side blank shown in FIG. 19, with both major and minor flaps folded to a closed position;

DETAILED DESCRIPTION

Figure 1:
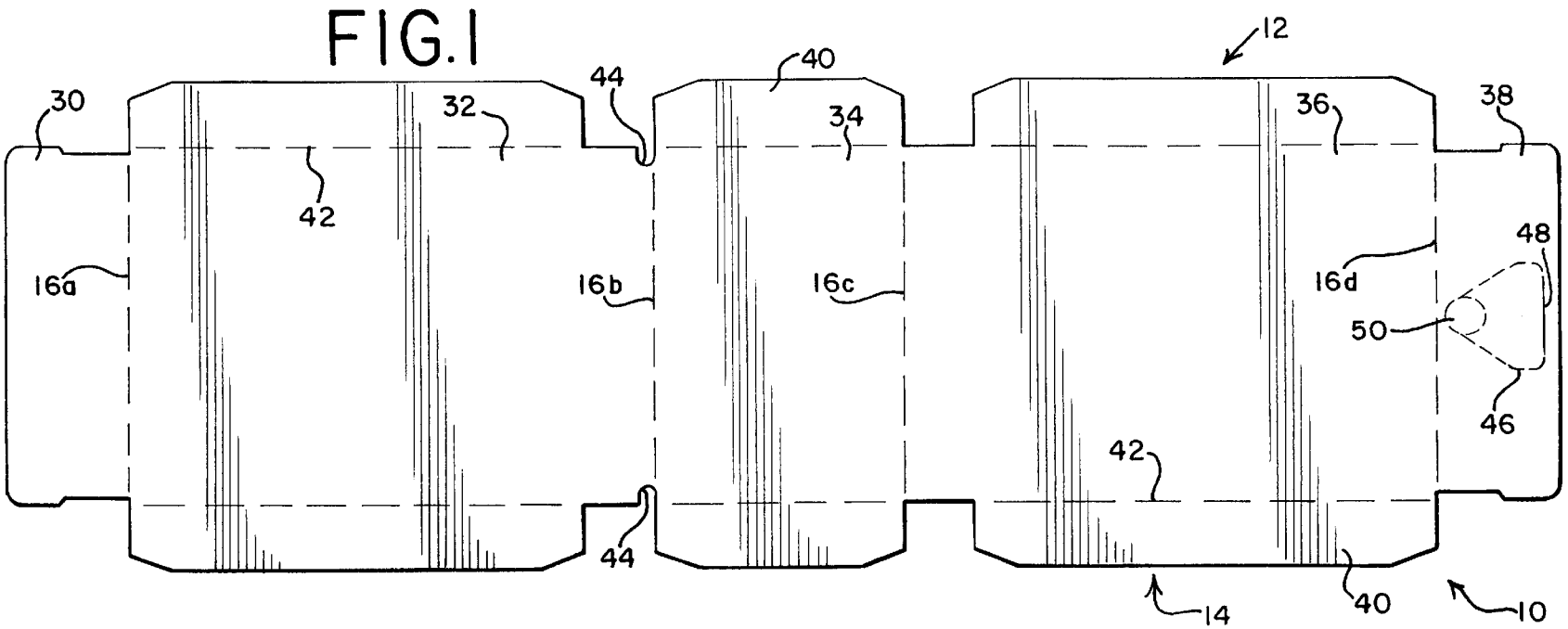
FIG. 1 is a plan view of an elongate body blank of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 shows an elongate body blank 10 having first and second lateral sides 12 and 14. Transverse fold lines 16*a–d* extend between the first and second lateral sides 12 and 14 to define a first, a second, a third, a fourth, and a fifth panel 30, 32, 34, 36, and 38. The body blank 10 may be folded along the transverse fold lines 16*a–d* to form a C-shaped sleeve. Preferably the body blank 10 is made from single-ply corrugated paperboard.

Body flanges 40 extend from the first and second lateral sides 12 and 14 of the body blank 10 at the second, third, and fourth panels, 32, 34, and 36. Marginal fold lines 42 separate the body flanges 40 from the body blank 10.

Notches 44 are removed from the first and second lateral edges 12 and 14 of the body blank 10 at the intersection of the second and third panels 32 and 34. The notches 44 provide a hole in the assembled container to allow for the passage of liquid and air.

The fifth panel 38 has a centrally located perforated section defining an access door 46. An upper portion of the door is not perforated so that it may function as a hinge 48. A circular shaped perforated section 50 at a distal end of the door 46 may be completely detached from the body blank 10 to form a circular hole. In the fully assembled container, the circular section 50 may be removed and the access door 46 pivoted outward to provide access to a fitment or spout of a bag (not shown) located within the assembled container. This access door 46 is not required when the assembled container is not used to ship liquid filled bags.

Figure 2:
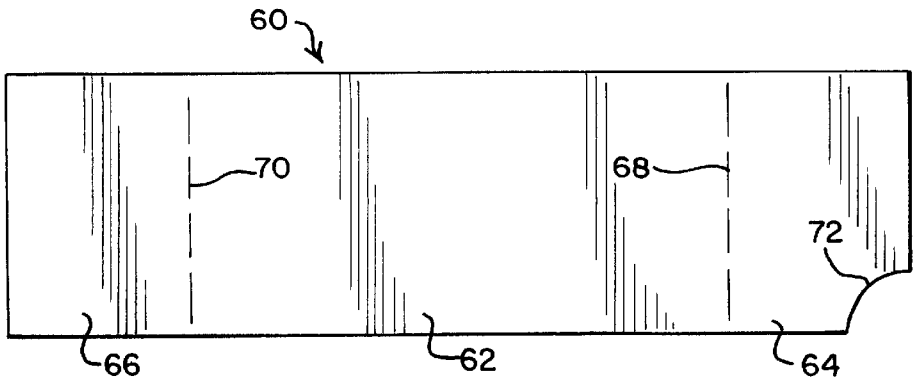
FIG. 2 is a plan view of the side blank of the present invention.

FIG. 2 shows a side blank 60 made of corrugated paperboard having a central panel 62 and top and bottom flaps 64 and 66 hingedly connected to the central panel 62 along respective creases 68 and 70. The top flaps 64 may sometimes be referred to as minor flaps. A notch 72 is removed from a portion of the minor flap 64 to accommodate the passage of a spout of a bag enclosed within an assembled container. Preferably, the side blank is made from double ply corrugated paper for increased structural support. Further, preferably the paperboard corrugations extend laterally so that top and bottom flaps 64 and 66 fold more easily along creases 68 and 70.

To erect a container 100 (FIG. 3) from the body blank 10 and the side blank 60 one must use one body blank 10 and two side blanks 60. The body blank 10 is folded along the fold lines 16*b* and 16*c* to form a C-shaped sleeve. Two side blanks 60 are inserted into the C-shaped sleeve at opposite lateral edges 12 and 14 of the body blank adjacent the marginal fold lines 42. Panels 32 and 36 and panels 62 (which sometimes may be referred to as sidewalls) of side blanks 60 define a rectangular sleeve 73. The rectangular sleeve 73 has first and second ends 102 and 104, and a depth and width dimension 106 and 108. The depth dimension 106 should be greater than the width dimension 108. (See FIG. 3).

Figures 3, 4, 6:
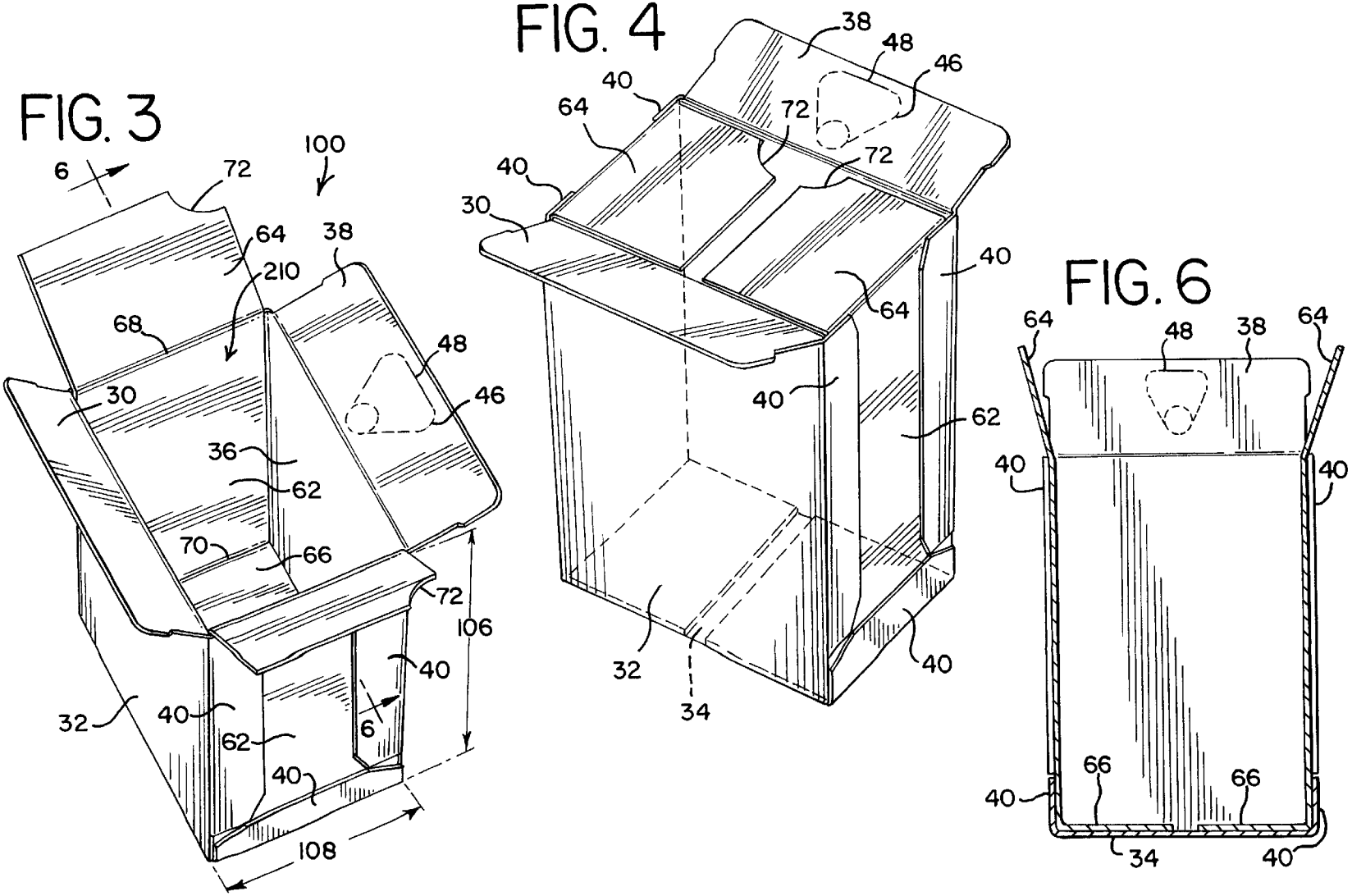
FIG. 3 is a perspective view of a container of the present invention constructed using the body blank shown in FIG. 1 and two side blanks shown in FIG. 2 in an open position.
FIG. 4 is a perspective view of the container of FIG. 3 with minor flaps folded to a closed position.
FIG. 6 is a cross-section taken along line 6—6 of FIG. 3.

The bottom flaps 66 of each of the side blanks 60 are folded inward along creases 70 and the bottom flaps 66 are attached to an inner surface of panel 34 (which sometimes may be referred to as the first end wall as it closes the first end of the rectangular sleeve 73) by gluing to form a double end wall. (FIG. 6). The notches 72 of the side blank 60 must each be facing panel 38 so that when folded inward to close the container they are in alignment with the access door 46. These notches are not required when the erected container is not used for shipping liquid filled bags.

The body flanges 40 along each lateral edge 12 and 14 of the body blank 10 are then folded inward along the marginal fold line 42 and attached to respective side blanks 60 by gluing. The flanges 40 form C-shaped supports 61 along a periphery of each of the side blanks 60, two of the legs 75 of the C-shaped support extend from the first end 102 of the rectangular sleeve 73 toward the second end 104 of the sleeve 73.

Figure 5:
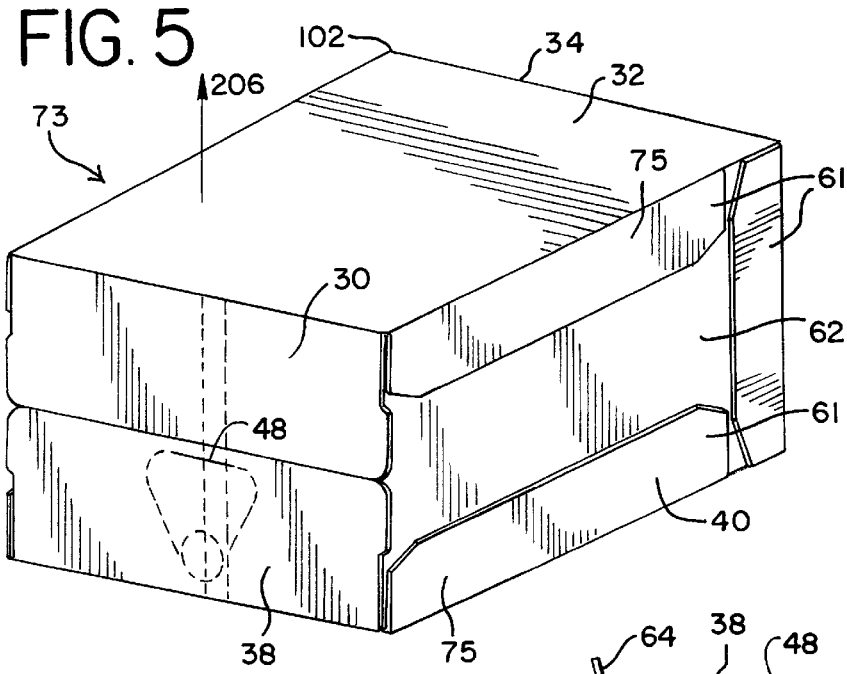
FIG. 5 is a perspective view of the container of FIG. 3 with both major and minor flaps folded to a closed position.

To close the second end 104 of rectangular sleeve 73 of the container 100, the minor flaps 64 of the side blank 60 are folded inward of the sleeve 73 along the fold lines 68 (FIG. 4). Then panels 30 and 38, which may be referred to as major flaps, are folded inward on top of the minor flaps 64 and glued thereto (FIG. 5) to close the container 100. If there is no access door 46 on container 100, the second end 104 of the sleeve 73 may also be closed by initially folding panels 30 and 38 inward before folding minor flaps 64.

When the container 100 is used to package a liquid filled plastic bag (not shown), the minor flaps 64 act as a plow to push the bag into the container 100 after loading. Further, the minor flaps 64 also serve to shield the bag from the damaging effects caused by contact with hot glue during the process of gluing the major flaps 30 and 38 to the minor flaps 64.

Figure 7:
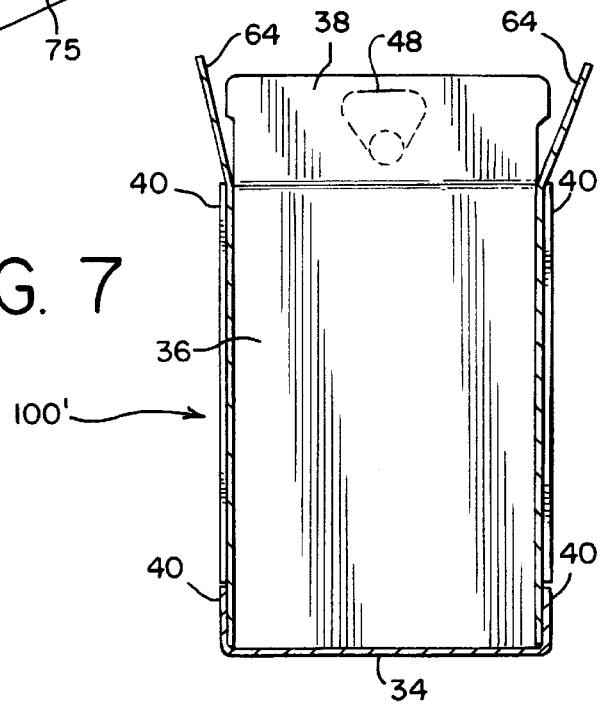
FIG. 7 is a cross-section of a second embodiment of the container of the present invention.
Figure 8:
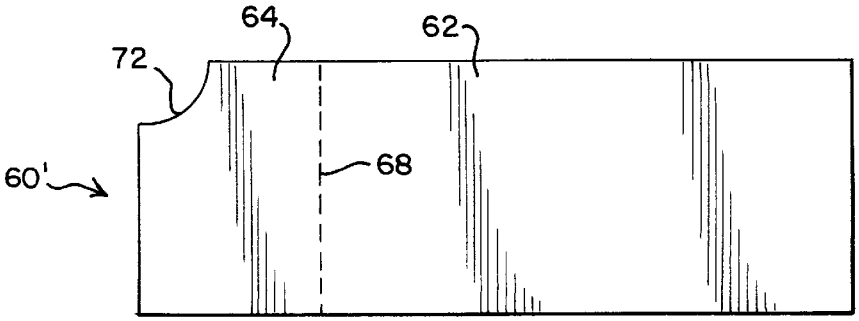
FIG. 8 is a plan view of a second embodiment of the side blank for constructing the container of FIG. 7.

In an alternate embodiment of the container 100', side blanks 60' shown in FIG. 8 are used instead of the side blank 60 shown in FIG. 2. Unlike side blank 60 (FIG. 2), side blank 60' does not include bottom flaps 66. Therefore, the first end wall 34 is of single thickness instead of double thickness. (FIG. 7). In all other respects the containers are the same; thus, the same numerical designations are used for corresponding parts.

Figure 11:
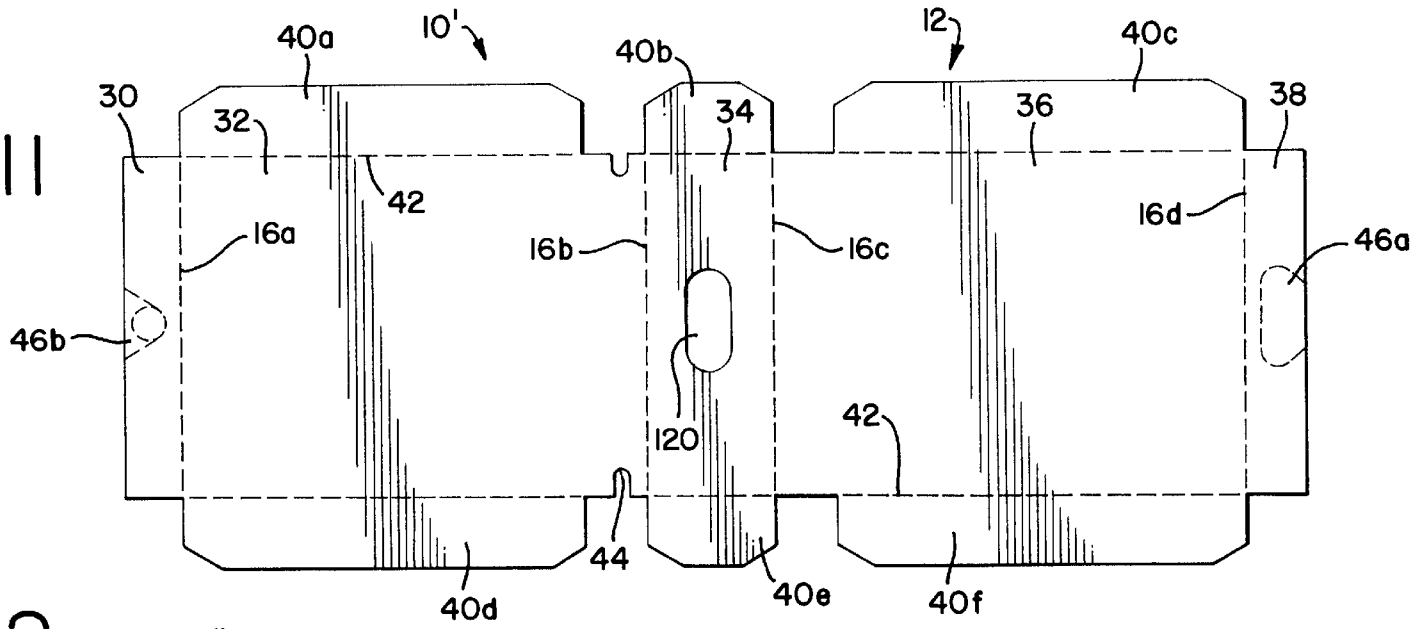
FIG. 11 is a plan view of a second embodiment of a body blank.
Figure 12:
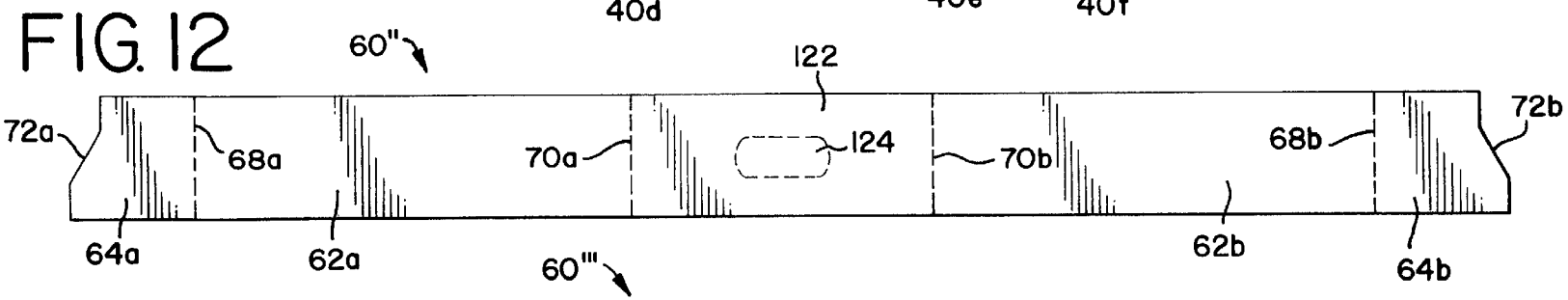
FIG. 12 is a plan view of a third embodiment of a side blank.
Figure 14:
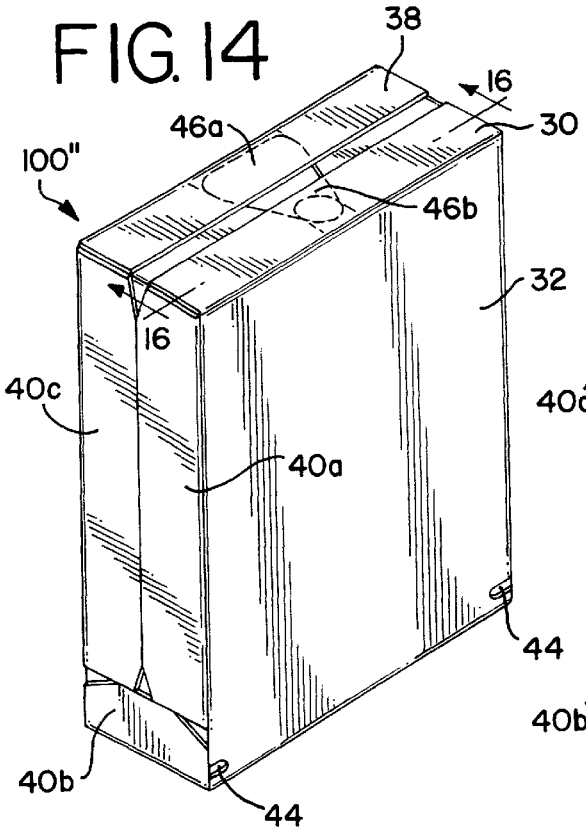
FIG. 14 is a perspective view of an alternate embodiment of a container constructed using the body blank shown in FIG. 11.

A second alternate embodiment, container 100" is shown in FIG. 14. Container 100" is constructed from body blank 10', shown in FIG. 11, and single side blank 60", shown in FIG. 12, in essentially the same manner as described above with respect to container 100. Unlike body blank 10, body blank 10' has an oblong shaped hole 120 on panel 34. Further, access door 46 is cooperatively formed by portions 46*a* and 46*b* located on respective panels 38 and 30. For the sake of further clarity, body flanges 40 are more particularly referred to as 40*a–f*.

Figure 16:
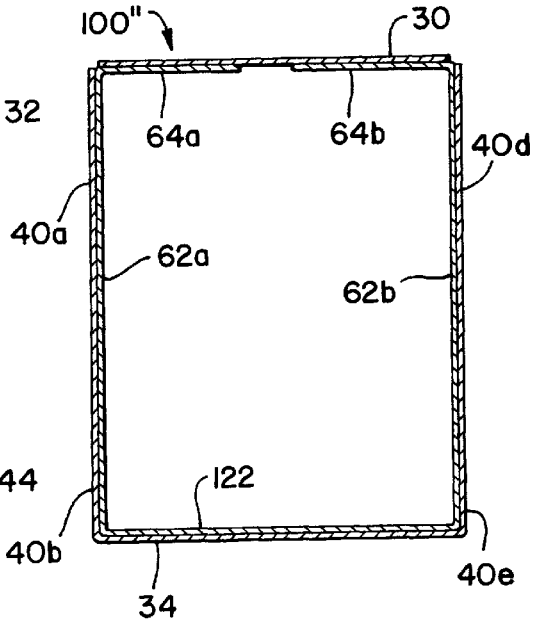
FIG. 16 is a section view taken along line 16≠of FIG. 14.

Unlike prior side blanks 60 and 60' that have required the use of two side blanks 60 for each body blank 10 to construct a container 100, only one side blank 60" per body blank 10' is required (FIG. 16). Side blank 60" has side panels 62*a* and 62*b*, and an end panel 122. End panel 122 has a centrally disposed frangible section 124. Frangible section 124 overlays hole 120 of panel 34, when constructed as a container 100", to define a positioning handle.

Figure 15:
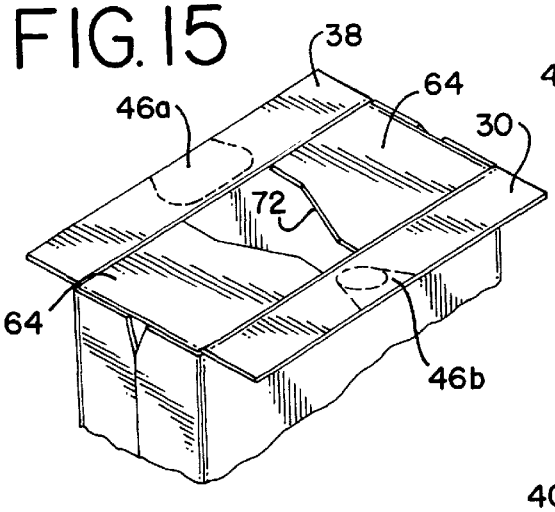
FIG. 15 is a perspective view, partially broken away, of a container constructed using the side blanks shown in FIGS. 12 and 13.

Side blank 60" has notches 72*a* and 72*b* removed, as do side blanks 60 and 60'. Notches 72*a* and 72*b* generally conform to the outer contours of access door 46 as shown in FIG. 15. The shape of notches 72*a* and 72*b* minimize the deleterious effects that may be caused by removal of paperboard to the structural integrity of the container. The shape of notches 72*a* and 72*b* also assists in minimizing the quantity of scrap material.

Figure 13:
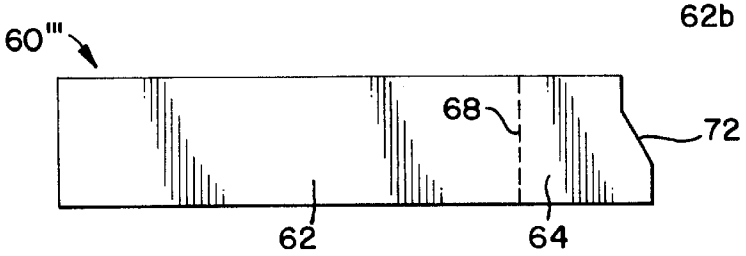
FIG. 13 is a plan view of a fourth embodiment of a side blank.
Figure 17:
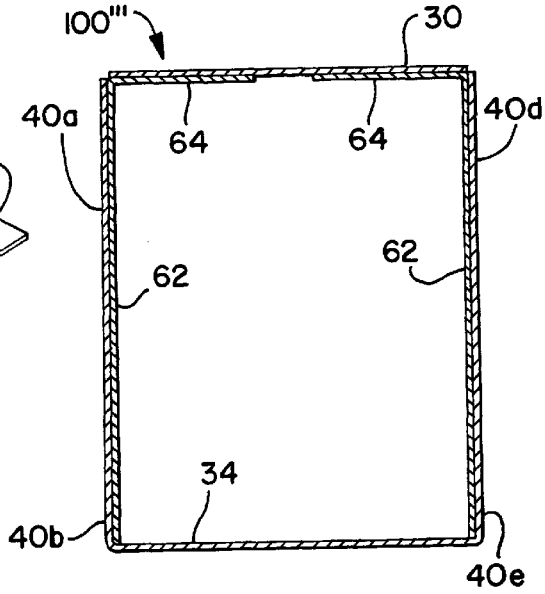
FIG. 17 is a section view of a container having an end wall of single wall thickness.

FIG. 13 shows yet another embodiment of side blank 60'". Side blank 60'" differs from side blank 60' in the shape of notch 72. In all other respects 60'" is the same as 60' and may be used in the same fashion as 60' to construct a container 100'" as shown in FIG. 17.

Figure 18:
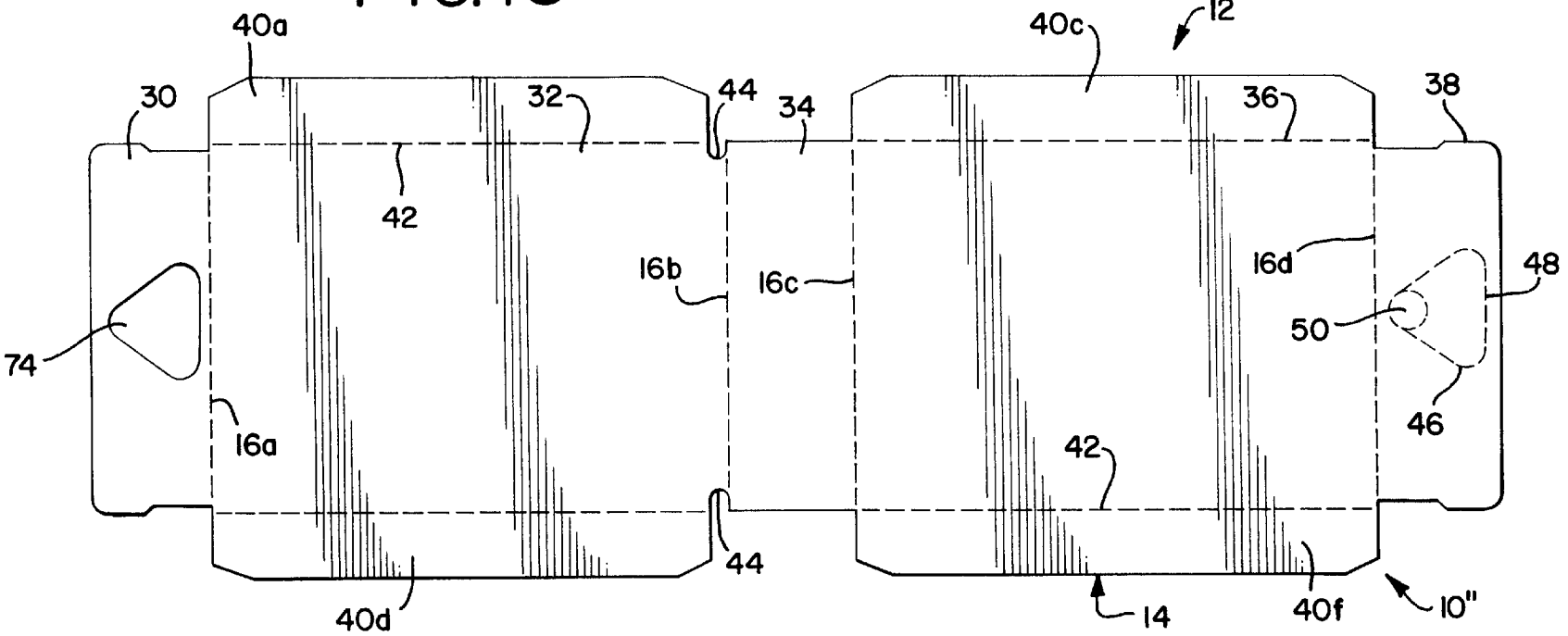
FIG. 18 is a plan view of a third embodiment of a body blank.
Figure 19:
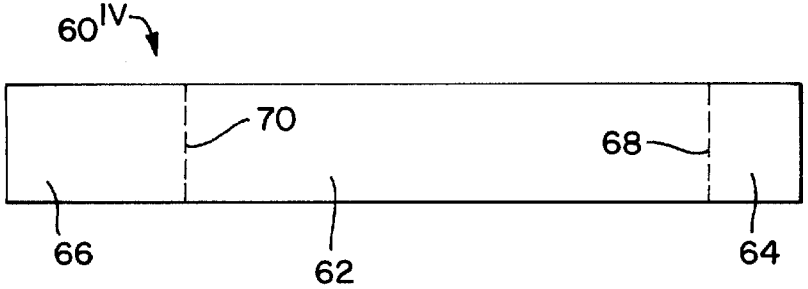
FIG. 19 is a plan view of a fifth embodiment of a side blank.

FIGS. 20–22 show another embodiment of container 100'" of the present invention. Container 100'" is constructed from body blank 10", shown in FIG. 18, and body blanks $60^{IV}$, shown in FIG. 19. Unlike container 100, container 100'" has four flanges (40*a*, 40*c*, 40*d*, 40*f*) to form parallel supports, rather than the C-shaped supports shown in FIG. 5. Also, there is a full overlap of fifth panel 38 over first panel 30. Access door 46 in container 100'" overlays an aperture 74 in the first panel, to allow access to the contents of the bag. Minor flaps 64 are short enough so that they do not interfere with the passage of the spout of the bag through access door 46. FIGS. 20–22 show container 100'" with both minor flaps folded to a closed position, with one major flap and both minor flaps folded to a closed position, and with both major and minor flaps folded to a closed position, respectively.

Figure 23:
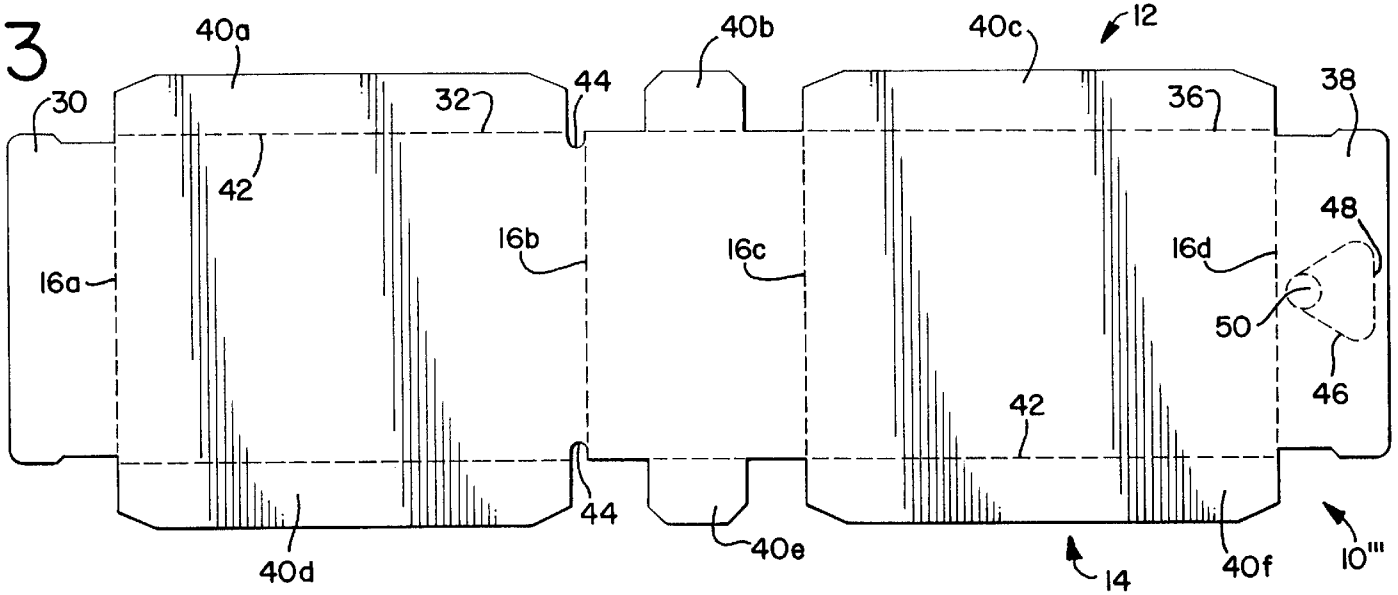
FIG. 23 is a plan view of a fourth embodiment of a body blank.
Figure 24:
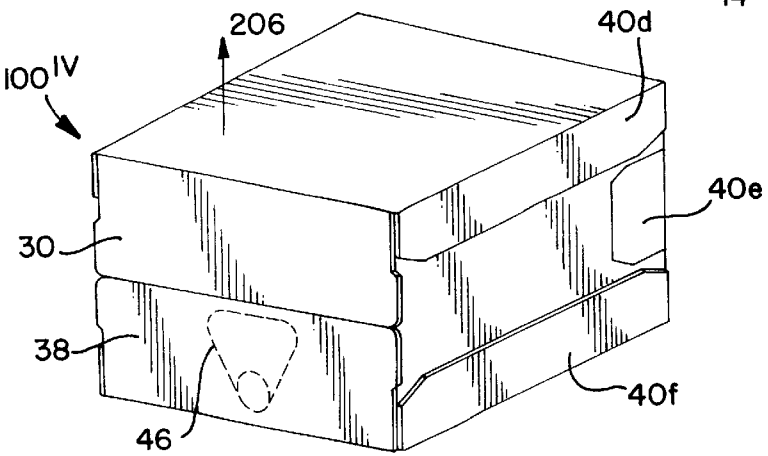
FIG. 24 is a perspective view of an alternate embodiment of the container constructed using the body blank shown in FIG. 23.

FIG. 24 shows another embodiment of the container $\mathbf{100}^{IV}$ of the present invention, constructed from body blank 10''', shown in FIG. 23. The difference between container $\mathbf{100}^{IV}$ and container 100 is in the C-shaped support. Whereas flanges 40*b* and 40*e* in container 100 extend throughout the width of container 100, in container $\mathbf{100}^{IV}$, flange 40*b* lies between flanges 40*a* and 40*c*, and flange 40*e* lies between flanges 40*d* and 40*f* respectively.

Figures 25, 26, 27:
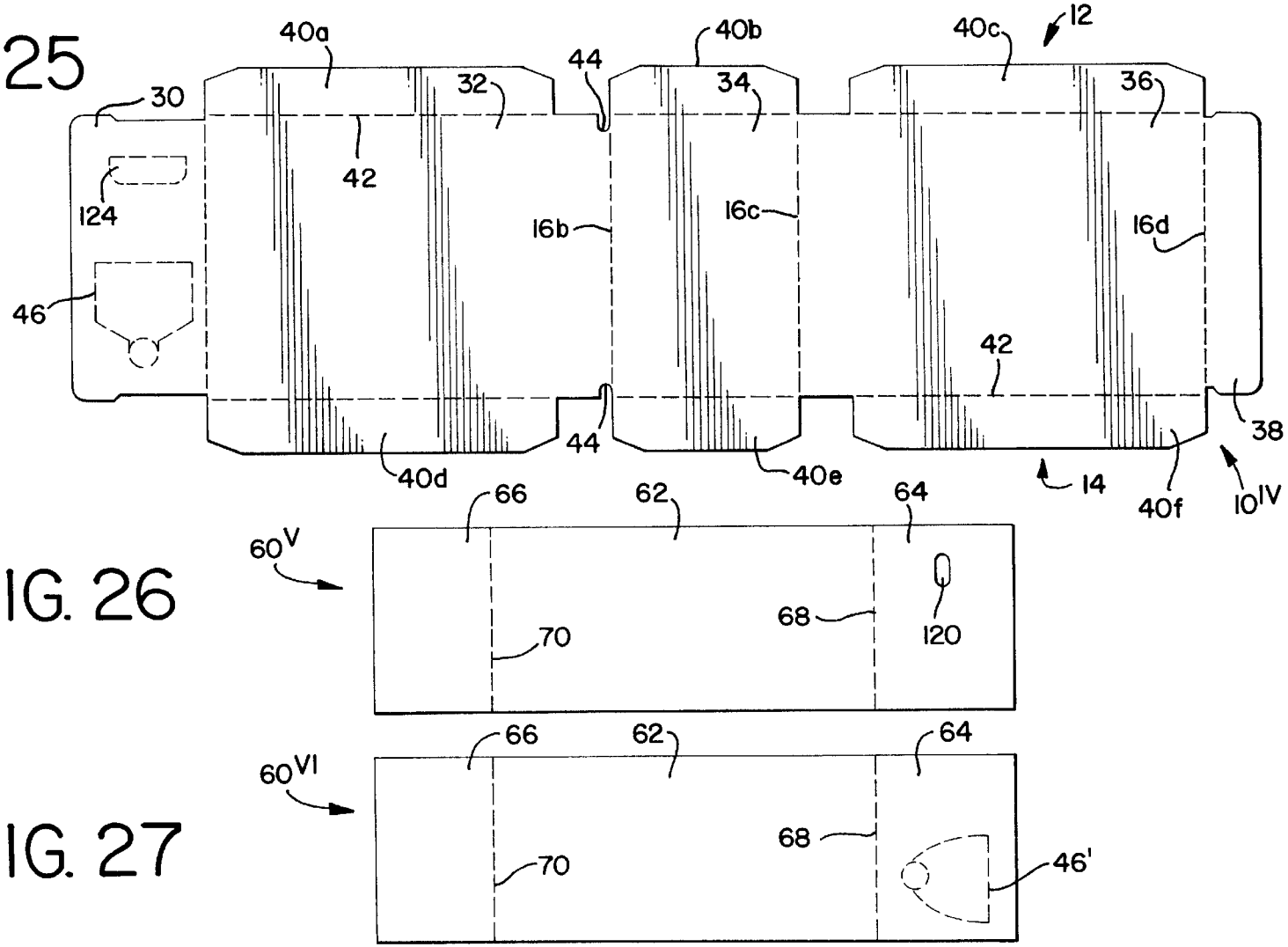
FIG. 25 is a plan view of a fifth embodiment of a body blank.
FIG. 26 is a plan view of a sixth embodiment of a side blank.
FIG. 27 is a plan view of a seventh embodiment of a side blank.
Figure 29:
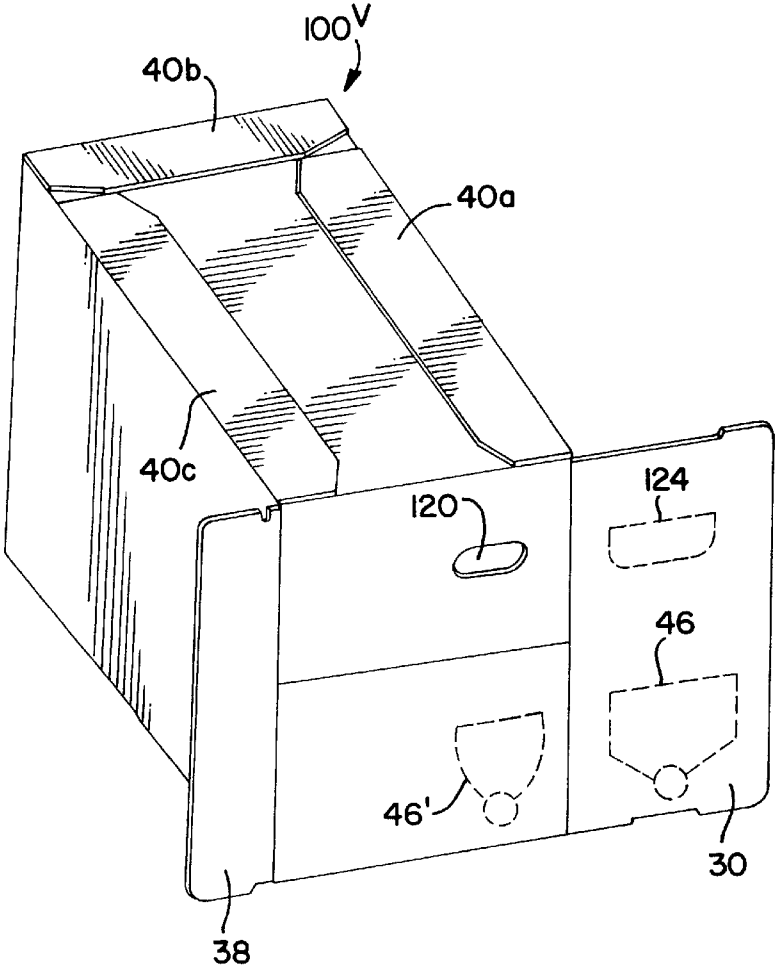
FIG. 29 is a perspective view of an alternate embodiment of the container constructed using the body blank shown in FIG. 25 and the side blanks shown in FIGS. 26 and 27, with the minor flaps folded to a closed position.
Figure 28:
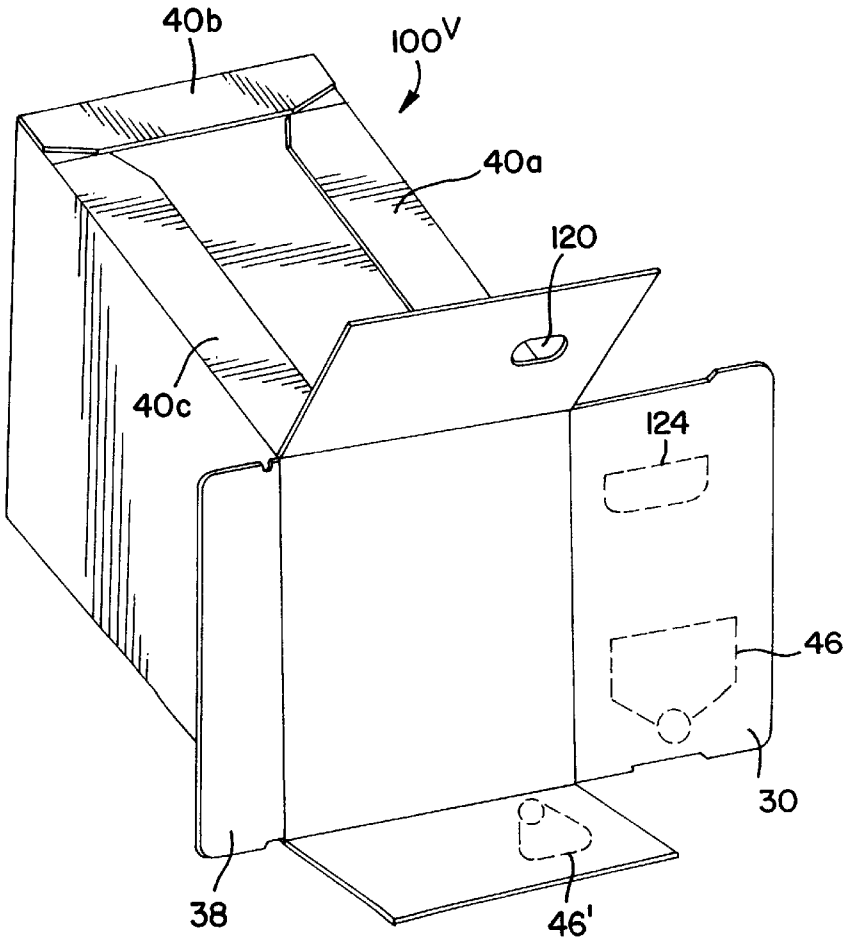
FIG. 28 is a perspective view of an alternate embodiment of the container constructed using the body blank shown in FIG. 25 and the side blanks shown in FIGS. 26 and 27, in an open position.
Figure 30:
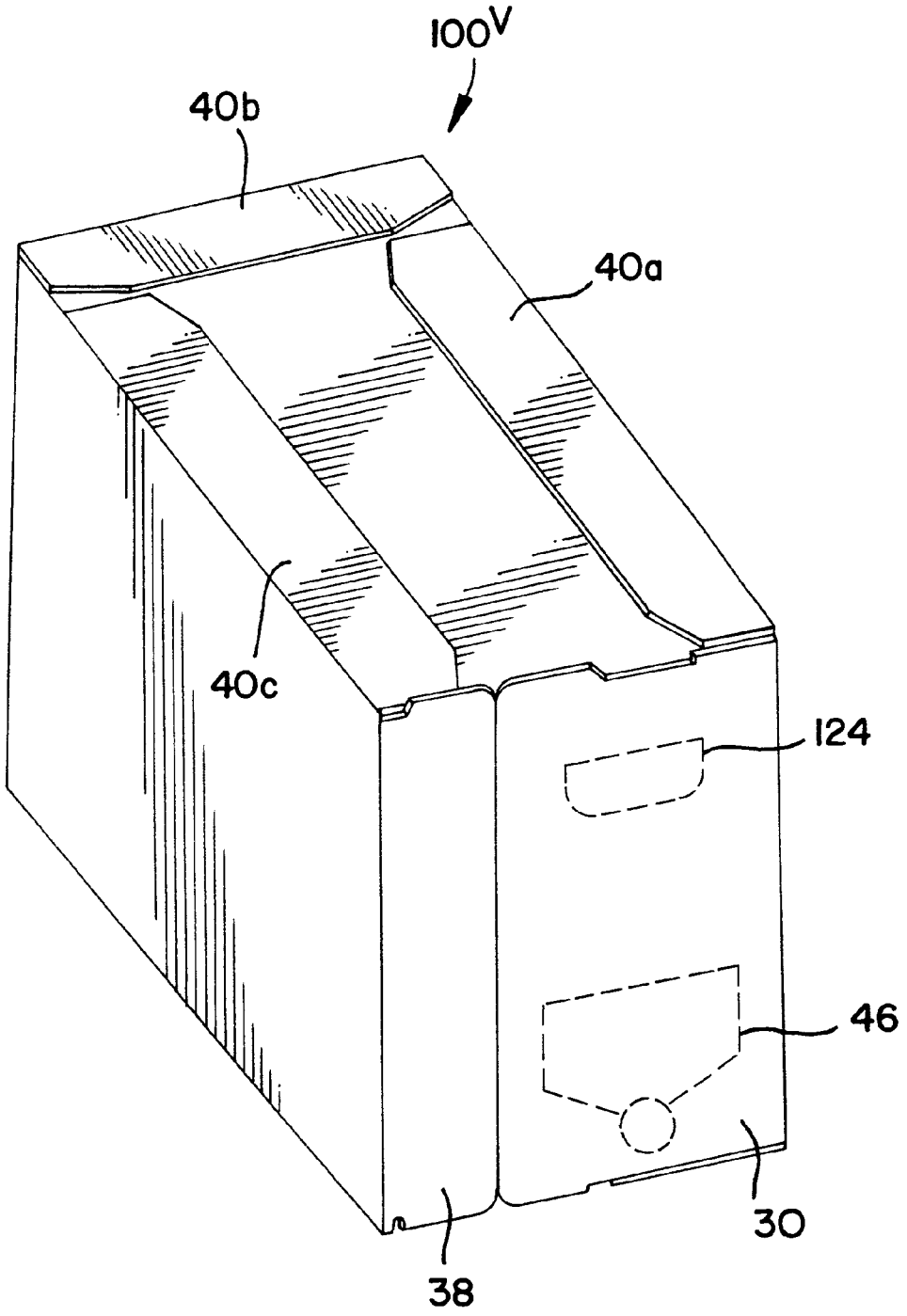
FIG. 30 is a perspective view of an alternate embodiment of the container constructed using the body blank shown in FIG. 25 and the side blanks shown in FIGS. 26 and 27, with both major and minor flaps folded to a closed position.

FIGS. 28–30 show another embodiment of container $\mathbf{100}^{V}$, constructed from body blank $\mathbf{10}^{IV}$, shown in FIG. 25 and body flanges $\mathbf{60}^{V}$ and $\mathbf{60}^{VI}$, shown in FIGS. 26 and 27, respectively. First panel 30 in body blank 10" is wider than fifth panel 38, and has both access door 46 and frangible section 124. Side blank $\mathbf{60}^{VI}$ also has an access door 46' to correspond with access door 46. Access doors 46 and 46' act as a double lock to anchor the spout of the bag within access doors 46 and 46'. Frangible section 124 overlays an oblong shaped hole 120 in side blank $\mathbf{60}^{V}$ to define a positioning handle above access door 46. FIGS. 28–30 show container $\mathbf{100}^{V}$ in an open position, with both minor flaps folded to a closed position, and with both major and minor flaps folded to a closed position, respectively.

Figure 31:
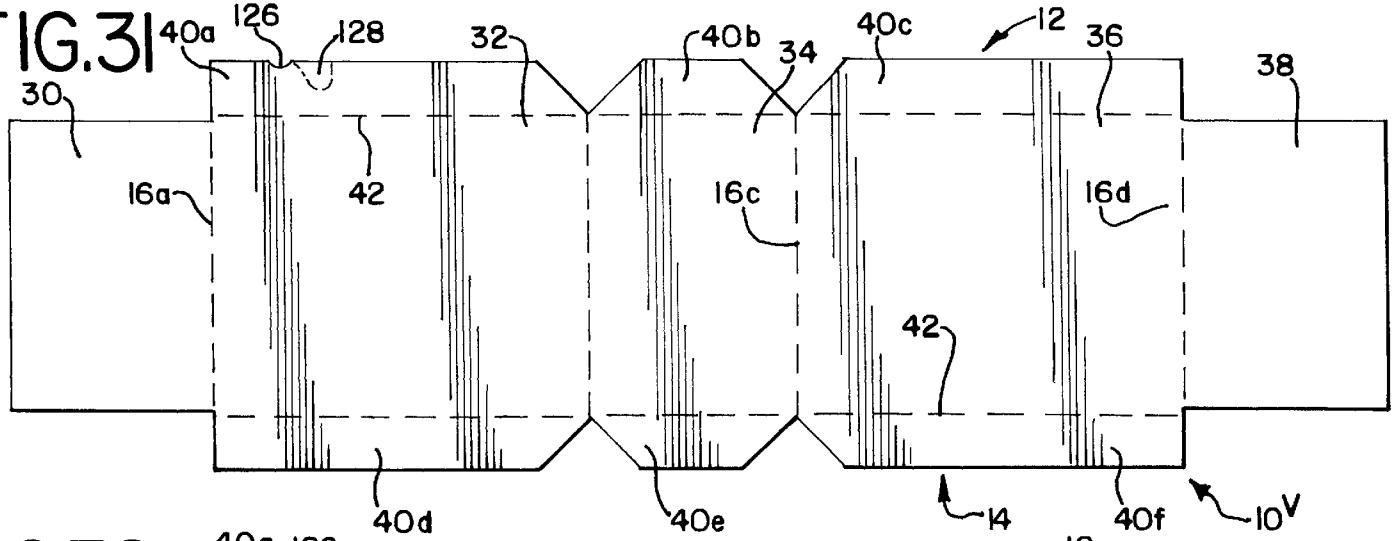
FIG. 31 is a plan view of a sixth embodiment of a body blank.

FIG. 31 shows an alternate embodiment of a body blank $\mathbf{10}^{V}$. The body flange 40*a* in the body blank $\mathbf{10}^{V}$ has a cutout section 126 and a perforated section 128 defining a portion of an access door 46. The cutout section 126 may also be defined as a perforated section, or, as shown in an alternate body blank $\mathbf{10}^{VI}$ in FIG. 32, a cutout section 130 may replace the perforated section 128.

Figure 32:
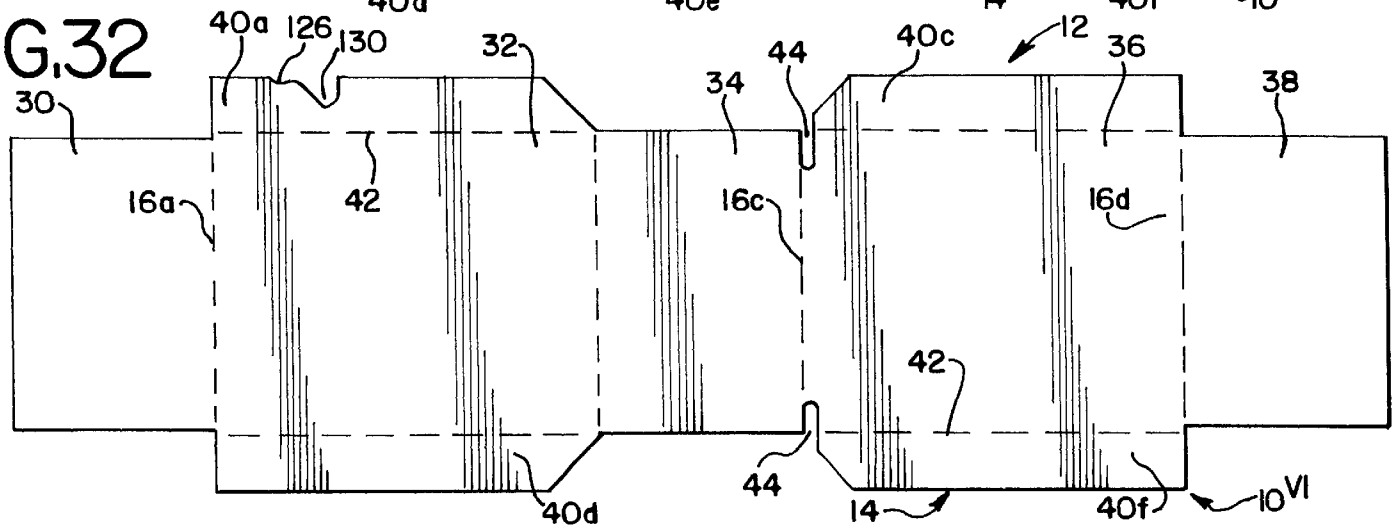
FIG. 32 is a plan view of a seventh embodiment of a body blank.

The body blank $\mathbf{10}_{V}$ in FIG. 31 has six body flanges 40*a–f*, while the body blank $\mathbf{10}^{VI}$ in FIG. 32 has four body flanges 40*a*, 40*c*, 40*d*, and 40*f*. Thus, in the assembled container, the body blank $\mathbf{10}^{V}$ will form C-shaped supports, while the body blank $\mathbf{10}^{VI}$ will form parallel supports.

In FIG. 32, notches 44 are removed from the first and second lateral edges 12 and 14 of the body blank $\mathbf{10}^{VI}$ at the intersection of the third and fourth panels 34 and 36. As discussed previously, notches 44 provide holes in the assembled container to allow for the passage of liquid and air.

Figures 33, 34, 35, 36, 37:
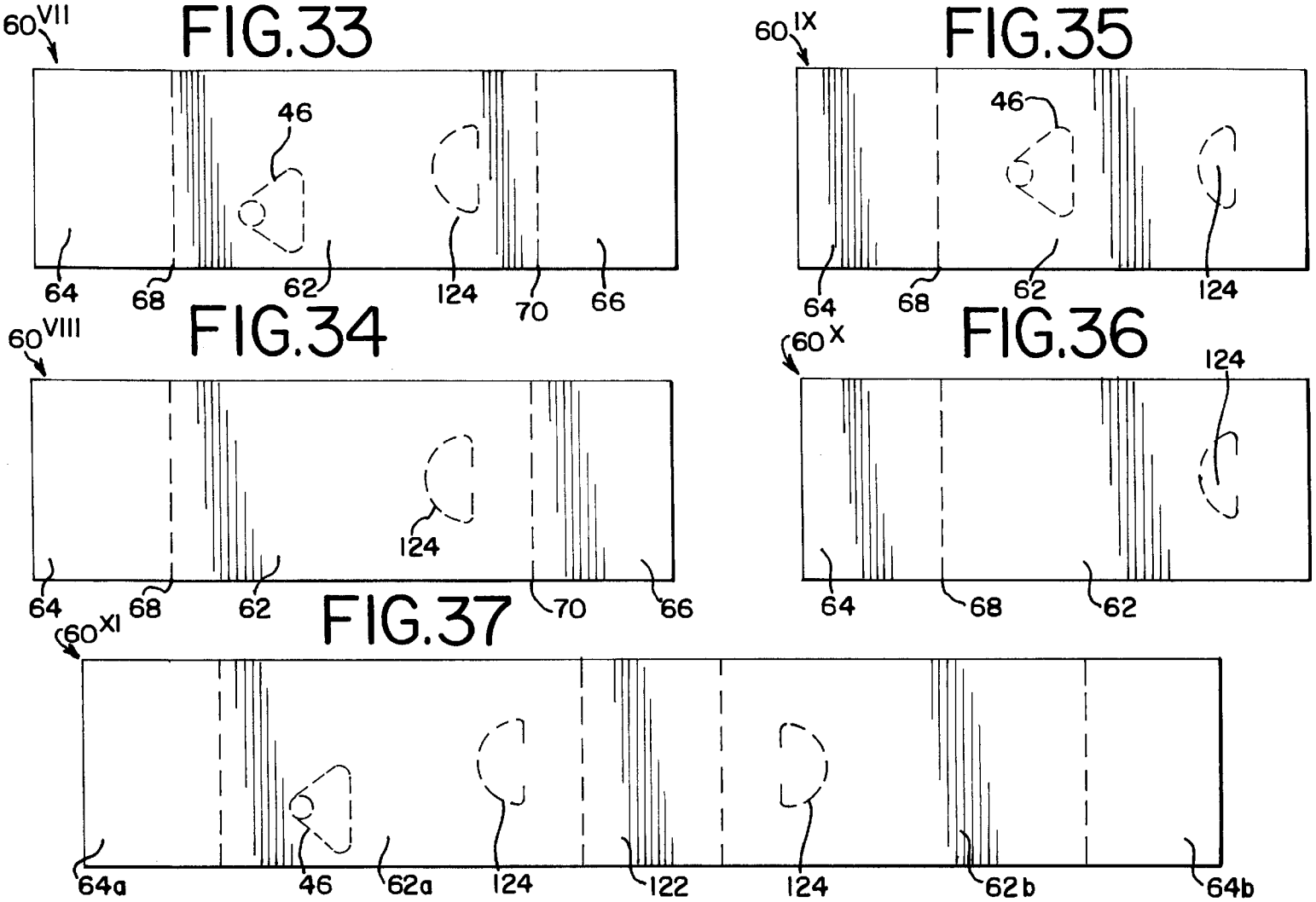
FIG. 33 is a plan view of an eighth embodiment of a side blank.
FIG. 34 is a plan view of a ninth embodiment of a side blank.
FIG. 35 is a plan view of a tenth embodiment of a side blank.
FIG. 36 is a plan view of an eleventh embodiment of a side blank.
FIG. 37 is a plan view of an twelfth embodiment of a side blank.

FIGS. 33 and 34 show alternate embodiments of side blanks $\mathbf{60}^{VII}$ and $\mathbf{60}^{VIII}$. The side blanks $\mathbf{60}^{VII}$ and $\mathbf{60}^{VIII}$ include top and bottom flaps 64 and 66 hingedly connected to the central panels 62 along respective creases 68 and 70. An access door 46 is located on side blank $\mathbf{60}^{VII}$. Frangible sections 124 on the side blanks $\mathbf{60}^{VII}$ and $\mathbf{60}^{VIII}$ define positioning handles. The frangible section 124 on the side blank $\mathbf{60}^{VII}$ is located above the access door 46.

FIGS. 35 and 36 show alternate embodiments of side blanks $\mathbf{60}^{IX}$ and $\mathbf{60}^{X}$. The side blanks $\mathbf{60}^{IX}$ and $\mathbf{60}^{X}$ do not have bottom flaps 66 hingedly connected to the central panel 62. In addition, the access door 46 in the body flange $\mathbf{60}^{IX}$ of FIG. 35 is centrally located, while the access door 46 in the body flange $\mathbf{60}^{VII}$ of FIG. 33 is closer to the edge of the central panel 62. The position of the access door 46 may vary anywhere on the central panel 62. In the preferred embodiment, the access door 46 is closer to the edge of the central panel 62 to limit the amount of liquid spilled onto the container $\mathbf{100}^{VI}$ when liquid is poured from the container $\mathbf{100}^{VI}$. In all other respects, the side blanks $\mathbf{60}^{VII}$ and $\mathbf{60}^{VIII}$ are the same as the side blanks $\mathbf{60}^{VII}$ and $\mathbf{60}^{VIII}$.

FIG. 37 shows an alternate embodiment of a side blank $\mathbf{60}^{XI}$. The side blank $\mathbf{60}^{XI}$ eliminates the necessity of using two side blanks for each body blank to construct the container. The side blank $\mathbf{60}^{XI}$ has top flaps 64*a* and 64*b*, side panels 62*a* and 62*b*, and an end panel 122. Both side panels 62*a* and 62*b* contain frangible sections 124, while the access door 46 is located only on the side panel 62*a*.

Figure 39:
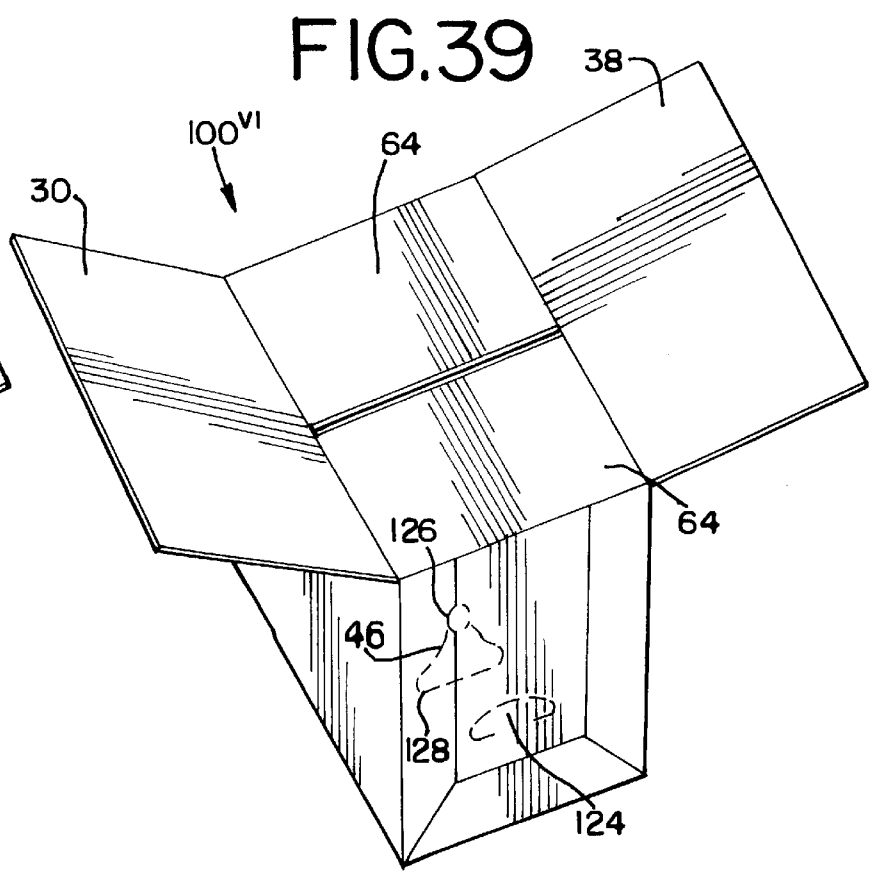
FIG. 39 is a perspective view of an alternate embodiment of the container constructed using the body blank shown in FIG. 31 and the side blanks shown in FIGS. 33 and 34, with the minor flaps folded to a closed position.
Figure 38:
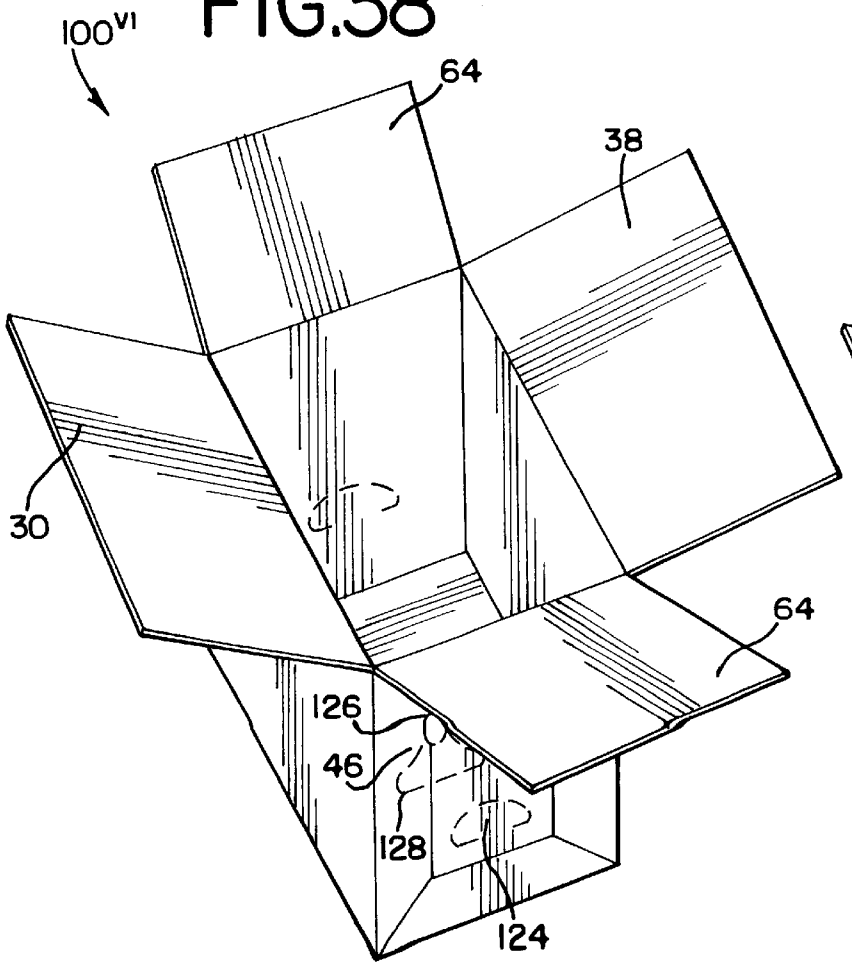
FIG. 38 is a perspective view of an alternate embodiment of the container constructed using the body blank shown in FIG. 31 and the side blanks shown in FIGS. 33 and 34, in an open position.
Figure 41:
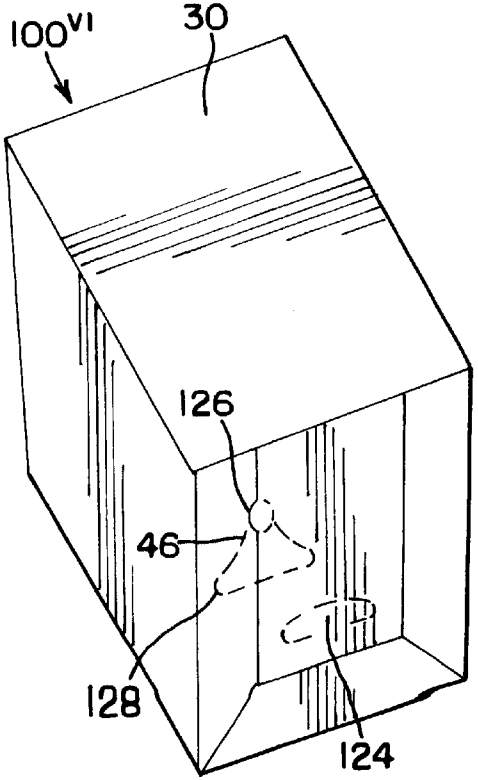
FIG. 41 is a perspective view of an alternate embodiment of the container constructed using the body blank shown in FIG. 31 and the side blanks shown in FIGS. 33 and 34, with the first sidewall folded to a closed position.
Figure 40:
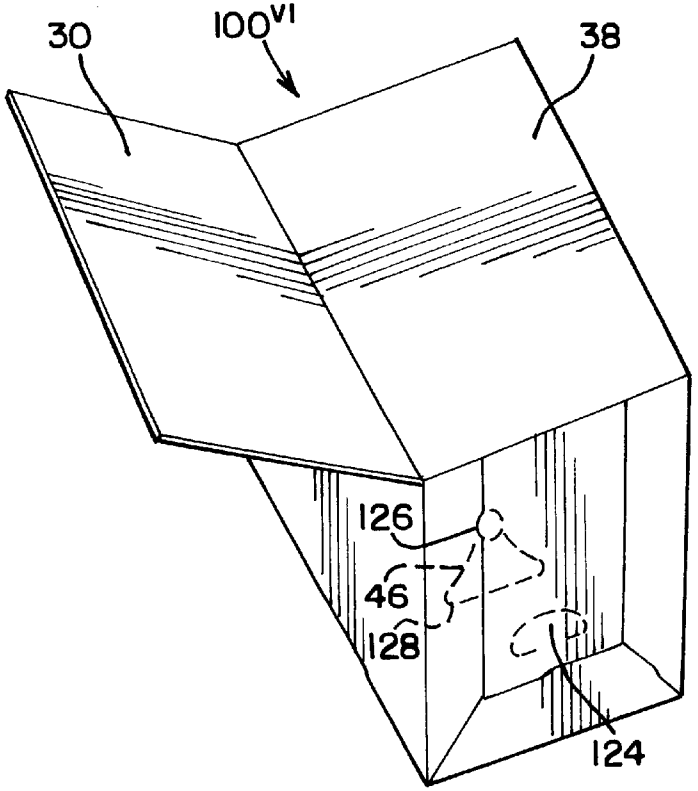
FIG. 40 is a perspective view of an alternate embodiment of the container constructed using the body blank shown in FIG. 31 and the side blanks shown in FIGS. 33 and 34, with the last sidewall folded to a closed position.

FIGS. 38–41 show another embodiment of container $\mathbf{100}^{VI}$, constructed from the body blank $\mathbf{10}^{V}$, shown in FIG. 31, and the body flanges $\mathbf{60}^{VII}$, and $\mathbf{60}^{VIII}$, shown in FIGS. 33 and 34, respectively. FIG. 38 shows the container $\mathbf{100}^{VI}$ in an open position, FIG. 39 shows the container $\mathbf{100}^{VI}$ with both minor flaps 64 folded to a closed position, FIG. 40 shows the container $\mathbf{10}^{VIII}$, with one major flap 38 and both minor flaps 64 folded to a closed position, and FIG. 41 shows the container $\mathbf{100}^{VI}$ with both major flaps 30 and 38 and minor flaps 64 folded to a closed position. As shown in FIG. 41, there is a full overlap of the first panel 30 over the fifth panel 38 to form a double sidewall. This provides a larger gluing surface to seal the container$^{VI}$, and also enables more force to be applied to the container$^{VI}$ when sealing the containers$_{VI}$.

Figure 10:
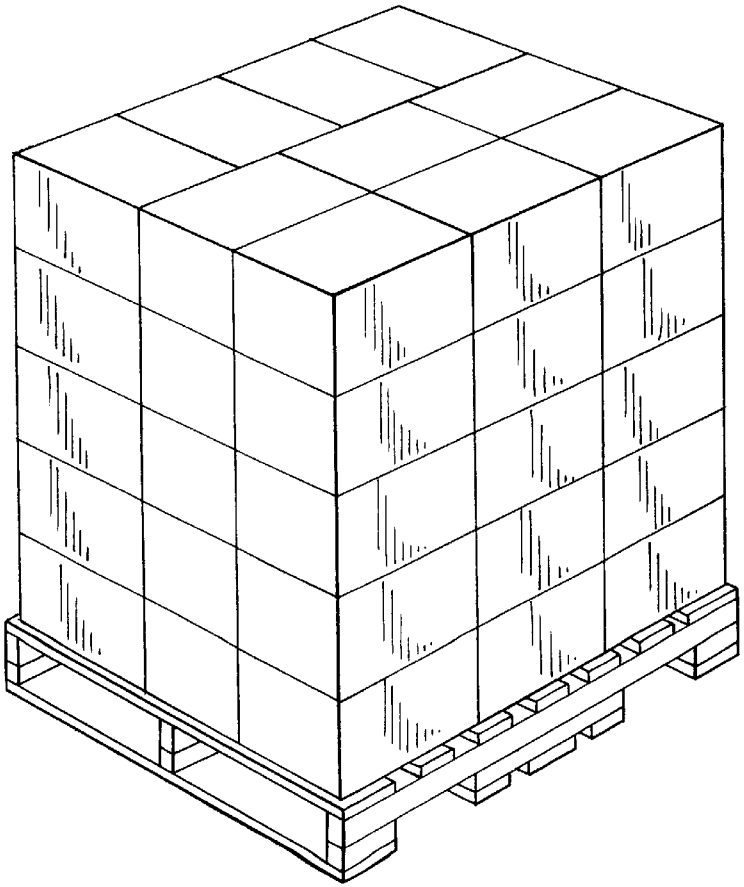
FIG. 10 is a diagrammatic view of containers stacked on a pallet in a columnar fashion.
Figure 9:
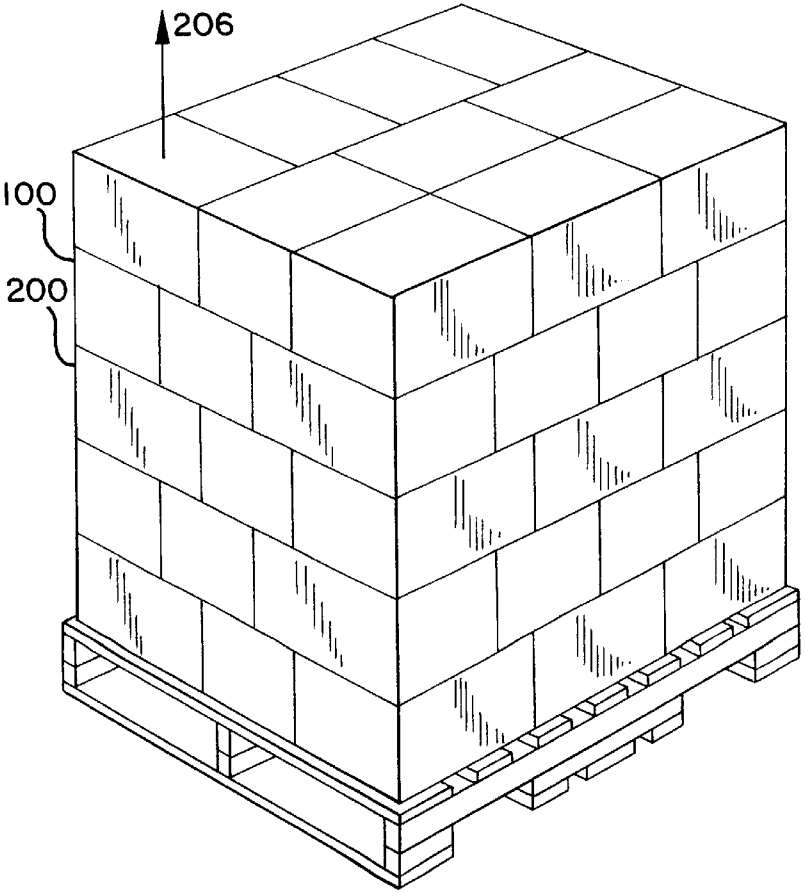
FIG. 9 is a diagrammatic view of containers stacked on a pallet in an interlocked fashion.

Because the major flaps 30 and 38 and minor flaps 64 are oriented along the axis in which the containers 100 will be stacked, or stacking axis 206, the containers 100 may be stacked on a pallet in an interlocking fashion (FIG. 9) instead of a columnar fashion (FIG. 10). The interlocking stacking arrangement allows for stacking containers 100 cross-wise on top of containers 200 located on a layer below. Prior art containers such as the one shown in the '278 Patent, had insufficient structural support to be stacked in an interlocking fashion and had to be stacked in conformation with one another in a columnar stacking fashion shown in FIG. 10. The interlocking stacking arrangement (FIG. 9) provides a more stable palletized load than the columnar stacking arrangement (FIG. 10).

Further, because of the increased support gained through the orientation of the major flaps 30 and 38 and minor flaps 64, an internal surface 210 along panels 32 and 36 and side blanks 60 of container 100 is a continuous, and smooth surface without the need of internal flanges 120 shown in the '278 Patent.

Because of the increased structural support of the container 100, the container 100 may be used to ship single shipments using a common carrier such as U.P.S.

While the present container 100 has been described as generally rectangularly shaped, it is anticipated that the container could be constructed having various polygonal—shapes without departing from the present invention. Also, while the second end 104 of the rectangular sleeve 73 is closed by the cooperative folding of major and minor flaps, it is anticipated that a single sidewall could carry a flap that could close the container 100 or a separate cap could be used to close the container 100 without departing from the present invention.

While the specific embodiments have been illustrated and described, numerous modifications come to mind without significantly departing from the spirit of the invention and the scope of protection is only limited by the scope of the accompanying claims.

We claim:

1. A container comprising:

a first sidewall;

a second sidewall hingedly connected to said first sidewall;

a third sidewall hingedly connected to said second sidewall;

a last sidewall;

a plurality of inner sidewalls hingedly connected to said third sidewall and said last sidewall, wherein said first sidewall overlaps said last sidewall to define a double sidewall, said double sidewall, said second sidewall, said third sidewall and said plurality of sidewalls defining a polygonal-shaped sleeve, the sleeve having first and second ends, inner and outer surfaces, and a depth dimension and a width dimension, the depth dimension being greater than the width dimension;

a first end wall at the first end of the sleeve to close the first end of the sleeve; and a second end wall at the second end of the sleeve to close the second end of the sleeve.

2. The container of claim 1 wherein the sleeve has a smooth inner surface.

3. The container of claim 1 further comprising:

a first support associated with the first end wall along one of said plurality of inner sidewalls; and a second support associated with the second end wall along one of said plurality of inner sidewalls.

4. The container of claim 1 further comprising:

a plurality of first supports associated with the first end wall along each of said plurality of inner sidewalls; and a plurality of second supports associated with the second end wall along each of said plurality of inner sidewalls.

5. The container of claim 1 further comprising:

a side flap hingedly connected to each of the plurality of inner sidewalls at said first end of the sleeve; and a side flag hingedly connected to each of the plurality of inner sidewalls at said second end of the sleeve.

6. A container comprising:

a first, a second, a third, a fourth and a last sidewalls defining a rectangular-shaped sleeve, wherein said first sidewall overlaps said last sidewall to define a double sidewall, said double sidewall is opposite said third sidewall and said second sidewall is opposite said fourth sidewall, the sleeve having first and second ends, inner and outer surfaces, and a depth dimension and a width dimension, the depth dimension being greater than the width dimension;

a first end wall at the first end of the sleeve to close the first end of the sleeve;

a second end wall at the second end of the sleeve to close the second end of the sleeve;

a first parallel support having a pair of legs associated with said first end wall along said second sidewall and said fourth sidewall; and a second parallel support having a pair of legs associated with said second end wall along said second sidewall and said fourth sidewall.

7. The container of claim 6 wherein one of the walls has a hole to allow for the passage of air or liquid.

8. The container of claim 6 further comprising:

a first perpendicular support associated with said first end wall along said third sidewall; and a second perpendicular support associated with said second end wall along said third sidewall.

9. The container of claim 6 further comprising an access door located on the first end wall.

10. The container of claim 6 further comprising:

a first side flap hingedly connected to the second sidewall at said first end of the sleeve;

a second side flap hingedly connected to the fourth sidewall at said first end of the sleeve;

a third side flap hingedly connected to the second sidewall at said second end of the sleeve; and a fourth side flap hingedly connected to the fourth sidewall at said second end of the sleeve.

11. The container of claim 10 further comprising:

a fifth side flap hingedly connected to the third sidewall at said first end of the sleeve; and a sixth side flap hingedly connected to the third sidewall at said second end of the sleeve.

12. The container of claim 11 further comprising an access door located on the first end wall.

13. The container of claim 12 wherein one flap from the group consisting of said first side flap, said second side flap and said fifth side flap has a cutout section and the cutout section overlaps said access door.

14. The container of claim 12 wherein one flap from the group consisting of said first side flap, said second side flap and said fifth side flap has a perforated section and the perforated section overlaps said access door.

15. The container of claim 6 further comprising a side panel wherein said first end wall and said second end wall are connected by said side panel, and said third sidewall overlaps said side panel to define a double third sidewall.

16. The container of claim 6 further comprising:

a first minor flap hingedly connected to said first end wall at said third sidewall; and a second minor flap hingedly connected to said second end wall at said third sidewall;

wherein said third sidewall overlaps said first and second minor flaps to define a double third sidewall.

17. The container of claim 6 further comprising:

a first minor flap hingedly connected to said first end wall at said double sidewall; and a second minor flap hingedly connected to said second end wall at said double sidewall;

wherein said double sidewall overlaps said first and second minor flaps to define a triple sidewall.

18. The container of claim 6 further comprising a handle on the first end wall.

19. The container of claim 6 further comprising a handle on the second end wall.

20. The container of claim 6 wherein the sleeve has a smooth inner surface.

21. A container comprising:

a first, a second, a third, a fourth and a last sidewalls defining a rectangular-shaped sleeve, wherein said first sidewall overlaps said last sidewall to define a double sidewall, said double sidewall is opposite said third sidewall and said second sidewall is opposite said fourth sidewall, the sleeve having first and second ends, inner and outer surfaces, and a depth dimension and a width dimension, the depth dimension being greater than the width dimension;

a first end wall at the first end of the sleeve to close the first end of the sleeve;

a second end wall at the second end of the sleeve to close the second end of the sleeve; and an access door located on the first end wall.

22. The container of claim 21 wherein the sleeve has a smooth inner surface.

23. The container of claim 21 wherein one of the walls has a hole to allow for the passage of air or liquid.

24. The container of claim 21 further comprising:

a first parallel support having a pair of legs associated with said first end wall along said second sidewall and said fourth sidewall; and a second parallel support having a pair of legs associated with said second end wall along said second sidewall and said fourth sidewall.

25. The container of claim 24 further comprising:

a first perpendicular support associated with said first end wall along said third sidewall; and a second perpendicular support associated with said second end wall along said third sidewall.

26. The container of claim 21 further comprising:

a first side flap hingedly connected to the second sidewall at said first end of the sleeve;

a second side flap hingedly connected to the fourth sidewall at said first end of the sleeve;

a third side flap hingedly connected to the second sidewall at said second end of the sleeve; and a fourth side flap hingedly connected to the fourth sidewall at said second end of the sleeve.

27. The container of claim 26 further comprising:

a fifth side flap hingedly connected to the third sidewall at said first end of the sleeve; and a sixth side flap hingedly connected to the third sidewall at said second end of the sleeve.

28. The container of claim 27 wherein one flap from the group consisting of said first side flap, said second side flap and said fifth side flap has a cutout section and the cutout section overlaps said access door.

29. The container of claim 27 wherein one flap from the group consisting of said first side flap, said second side flap and said fifth side flap has a perforated section and the perforated section overlaps said access door.

30. The container of claim 21 further comprising a side panel wherein said first end wall and said second end wall are connected by said side panel, and said third sidewall overlaps said side panel to define a double third sidewall.

31. The container of claim 21 further comprising:

a first minor flap hingedly connected to said first end wall at said third sidewall; and a second minor flap hingedly connected to said second end wall at said third sidewall;

wherein said third sidewall overlaps said first and second minor flaps to define a double third sidewall.

32. The container of claim 21 further comprising:

a first minor flap hingedly connected to said first end wall at said double sidewall; and a second minor flap hingedly connected to said second end wall at said double sidewall;

wherein said double sidewall overlaps said first and second minor flaps to define a triple sidewall.

33. The container of claim 21 further comprising a handle on the first end wall.

34. The container of claim 21 further comprising a handle on the second end wall.

35. A container comprising:

a first sidewall;

a second sidewall hingedly connected to said first sidewall;

a third sidewall hingedly connected to said second sidewall;

a last sidewall;

wherein said first sidewall overlaps said last sidewall to define a double sidewall, said double sidewall, said second sidewall and said third sidewall defining a triangular-shaped sleeve, the sleeve having first and second ends, inner and outer surfaces, and a depth dimension and a width dimension, the depth dimension being greater than the width dimension;

a first end wall at the first end of the sleeve to close the first end of the sleeve; and a second end wall at the second end of the sleeve to close the second end of the sleeve.

36. The container of claim 35 wherein the sleeve has a smooth inner surface.

37. The container of claim 35 further comprising:

a first support associated with the first end wall along one of said sidewalls; and a second support associated with the second end wall along one of said sidewalls.

38. The container of claim 35 further comprising:

a first support associated with the first end wall along said second sidewall;

a second support associated with the second end wall along said second sidewall;

a third support associated with the first end wall along said third sidewall; and a fourth support associated with the second end wall along said third sidewall.

39. The container of claim 38 further comprising:

a fifth support associated with the first end wall along said double sidewall; and a sixth support associated with the second end wall along said double sidewall.

* * * * *